United States Patent [19]

Maddalozzo

[11] Patent Number: 4,531,709

[45] Date of Patent: Jul. 30, 1985

[54] HYDRAULIC CONTROL VALVE WITH FLUID DAMPENING SYSTEM

[75] Inventor: Raymond J. Maddalozzo, Chicago, Ill.

[73] Assignee: Dresser Industries, Inc., Dallas, Tex.

[21] Appl. No.: 557,309

[22] Filed: Dec. 2, 1983

[51] Int. Cl.[3] ..... F15B 13/01

[52] U.S. Cl. ..... 251/48; 137/625.69; 251/54; 251/297

[58] Field of Search ..... 137/625.69; 251/48, 251/51, 54, 297

[56] References Cited

U.S. PATENT DOCUMENTS

| | | | |
|---|---|---|---|
| 2,403,519 | 7/1946 | Gardiner | 137/625.69 X |
| 2,798,461 | 7/1957 | Gold et al. | 137/625.69 |
| 2,919,679 | 1/1960 | Lincoln et al. | 251/54 X |
| 3,762,442 | 10/1973 | Paul | 251/297 X |

*Primary Examiner*—Gerald A. Michalsky

*Attorney, Agent, or Firm*—Barry E. Deutsch

[57] ABSTRACT

A hydraulic control valve includes a spool valve intermittently movable between a neutral position and a more preselected axially spaced position. The spool valve is latched in said preselected position. The valve further includes a fluid dampening system. The system includes a fluid receiving chamber in said control valve. A piston is movably disposed within the chamber. A fluid supply is connected to the chamber for delivering fluid thereinto. A fluid flow control device regulates the flow of fluid from said chamber. As the spool valve is moved towards its neutral position from the preselected position, the piston is displaced to discharge fluid from the chamber through the fluid flow control device. A fluid reactive force is generated by the discharge of fluid from the chamber, with the fluid reactive force acting on the spool valve to dampen movement thereof towards its neutral position.

6 Claims, 2 Drawing Figures

HYDRAULIC CONTROL VALVE WITH FLUID DAMPENING SYSTEM

BACKGROUND OF THE INVENTION

The present invention relates to a hydraulic control valve of the type used on earth working equipment, and in particular, to such a valve having a fluid dampening system for restraining movement of a spool valve of the hydraulic control valve from a first operating position towards a neutral position.

In bucket loaders and similar earth working equipment, hydraulic control circuits are employed for directing hydraulic fluid flow to and from a fluid motor or fluid actuator. The hydraulic control circuits have hydraulic control valves disposed therein for controlling and regulating the flow of hydraulic fluid.

Very often, the control valves have detent devices for maintaining the operating mechanism of the control valve in a desired operating position. A hydraulic control valve generally includes a spool valve or similar axially movable valve member. The detent device functions to latch the valve member in a selected operating position. When the detent device is released, it has been found that the spool valve may overshoot the neutral position as it returns thereto from its previously latched operating position. The overtravel results from high inertia forces created when control levers for the detent devices are released quickly. As the detent forces are normally maintained at a minimum level to minimize operator fatigue, the release of the detent device abruptly permits the spool valve to return to the neutral position from its latched operating position.

To overcome the foregoing problems, the hydraulic control valve includes a fluid dampening system for preventing overtravel of the spool as it moves towards the neutral position from a first operating position. The dampening system further controls the speed at which the spool valve travels towards the neutral position.

SUMMARY OF THE INVENTION

Accordingly, it is an object of this invention to absorb excessive energy resulting from the abrupt release of a spool valve of a hydraulic control valve.

The foregoing objective is achieved in a hydraulic control valve comprising a valve housing; an axially movable spool valve normally disposed in a neutral position within said housing; first force producing means connected to and intermittently actuating the spool valve for moving the valve in an axial direction within the housing from the neutral position; means for latching the spool valve at a predetermined axial position spaced from the neutral position; second force producing means connected to the spool valve for delatching and returning said valve to its neutral position when the first force producing means is deactuated; and a dampening system for controlling the return movement of the valve to the neutral position from its latched axial position including means defining a chamber, piston means movably disposed within the chamber, fluid supply means for delivering fluid into the chamber, fluid flow control means for controlling the flow of fluid from the chamber, and means responsive to movement of the valve from its latched position towards the neutral position for axially displacing the piston within the chamber to reduce the effective volume thereof, and develop a hydraulic force as the fluid is forced from the chamber under control of said fluid flow control means, the hydraulic force acting in opposition to the spool valve return force generated by said second force producing means to dampen movement of the valve towards said neutral position.

DESCRIPTION OF THE PREFERRED EMBODIMENT

Figure 1:
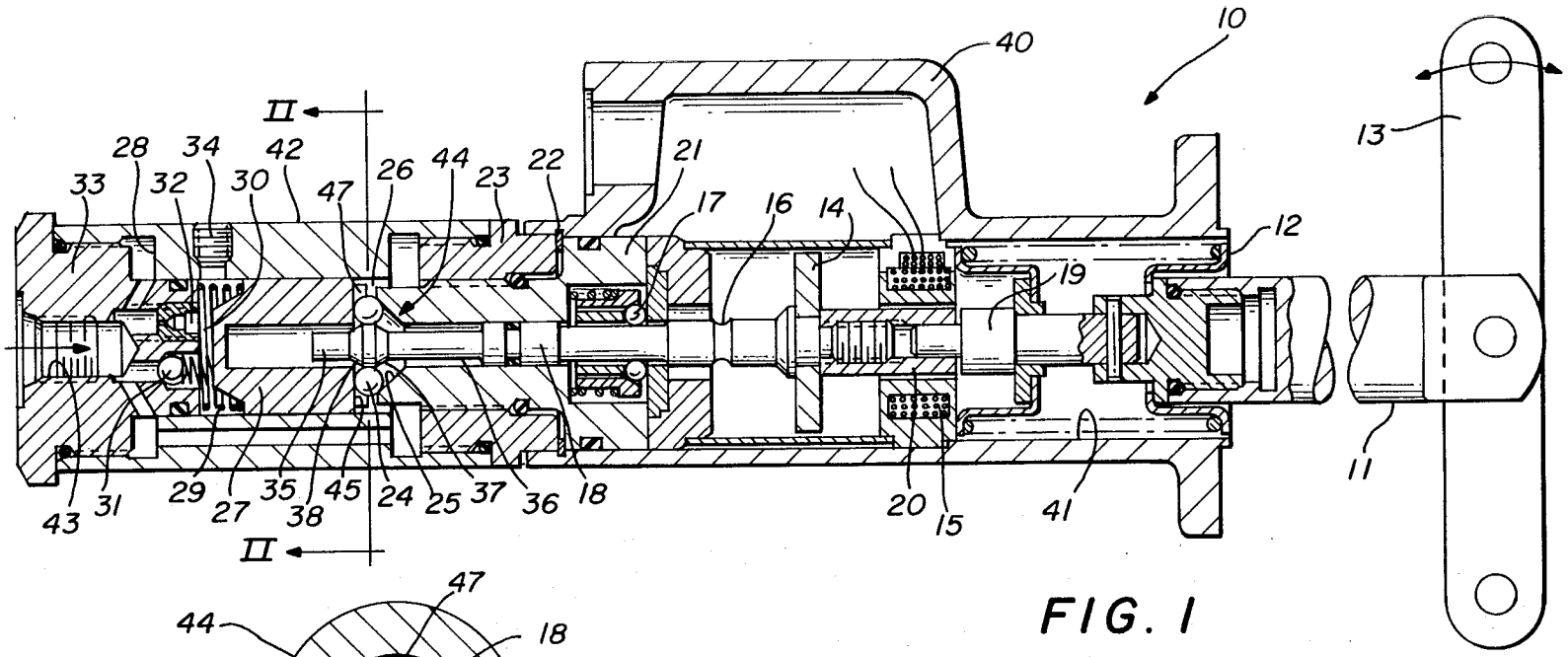
FIG. 1 of the drawing is a cross sectional view of a hydraulic control valve including the fluid dampening system of the present invention.

Referring now to the drawing, there is disclosed a preferred embodiment of the present invention. In particular, there is disclosed a hydraulic control valve 10 including the fluid dampening system of the present invention. Control valve 10 includes housing 40 having an axially movable control spool 11 disposed within an axially elongated chamber 41 defined by housing 40. Spring 12 maintains control spool 11 in a desired position. An operating lever 13 is connected to the control spool for moving the spool in a desired axially direction within chamber 41. Magnetically attracted cylindrical disc 14 is mounted on spool 11. Electromagnet 15 is provided within cylinder 41 and is axially spaced from disc 14. Spool 11 has a detent groove 16 formed thereon. Detent balls 17 overlie spool 11 and engage detent groove 16 when spool 11 has moved axially a predetermined distance to the left as viewed in the drawing. Upon engagement of balls 17 within groove 16, further axial movement of the spool in the same direction is prevented.

Figure 2:
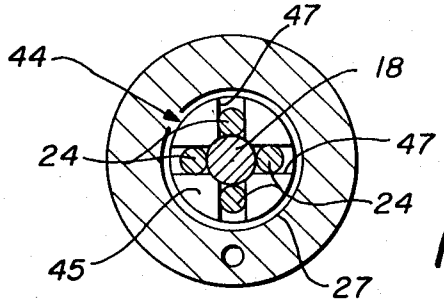
FIG. 2 is a sectional view, taken along line II—II of FIG. 1.

Detent cam 18 is attached to control spool 11 by means of a pinned assembly comprising spacer 19 and spacer link 20. Detent cam bushing 21 is radially spaced about cam 18 and is provided to axially guide the detent cam as it moves in response to movement of control spool 11. Detent cam bushing 21 is maintained in position with respect to snap ring 22 by locking nut 23. Detent cam bushing 21 terminates at one end in conical surfaces 25. Balls 24 rest against conical surfaces 25 and guide grooves 47 on face 45 of piston 27 (see FIG. 2). Balls 24 are provided in space 26 defined between opposed surfaces of cam bushing 21 and piston 27. Piston 27 moves in cylinder 28 defined by cylindrical housing sleeve 42. Biasing spring 29 provides a force to move piston 27 axially to the right as viewed in the drawing. Spring 29 is disposed within chamber 30.

Check valve 31 controls the flow of fluid from inlet port 43 into chamber 30. Orifice 32 is provided to control the flow of fluid from chamber 30. Inlet port 43, check valve 31, and orifice 32 are contained in cylindrical plug 33. Plug 34, disposed in cylindrical housing sleeve 42, is used to vent air from chamber 30.

Detent cam means 18 includes reduced diameter portions 35 and 36. Portions 35 and 36 are axially spaced. Interposed between portions 35 and 36 is an enlarged diametrical portion 44 including conical ramp surfaces 37 and 38. Surfaces 37 and 38, when engaged with balls 24, impart a vertical motion to the balls for reason to be more fully explained hereinafter.

In operation, let us assume control spool 11 is positioned as illustrated in the Figure of the drawing. It is assumed that this position is a "neutral" position. Spring 12 maintains spool 11 in the neutral position in the absence of any opposing force. Operating lever 13 is provided for moving the spool axially within housing 40. Initially, let us assume the spool is moved to the right to a first operating position as viewed in the Figure of the drawing, by action of the operating lever 13. Disc 14, mounted on spool 11, engages electromagnet 15 and spring 12 is compressed. Spool 11 is maintained in its new position until operating lever 13 provides a force to overcome the electromagnetic force holding disc 14 and thus spool 11 in its new position. When the opposition force provided by operating lever 13 overcomes the electromagnetic holding force, spring 12 returns the spool to its neutral position.

When lever 13 moves spool 11 axially from its "neutral" position to the left as viewed in the Figure of the drawing to a second operating position, as for example toward a float position, detent groove 16 engages detent balls 17 and spring 12 is compressed. The foregoing limits the axial movement of spool 11. Control spool 11 remains in the float position until control lever 13 provides a force to move the spool to its initial neutral position.

When the detent force holding control spool 11 in either operating position is overcome, spring 12 provides the force to return the spool to its initial "neutral" position. It is desirable that spool 11 return to its neutral position smoothly and without overtravel. Control lever 13 has the potential for developing high inertia forces on spool 11, which forces greatly exceed the force provided by spring 12. High inertia forces are developed when the control levers are released quickly and will result in overtravel of the spool. Detent forces for maintaining spool 11 in one of the described operating positions, are normally maintained at a low level to minimize operator fatigue, and in many cases, are too low to overcome high inertia forces. The present invention eliminates overtravel of the spool and regulates the speed at which the spool approaches its neutral position by using a fluid dampening system to absorb excess energy. The elimination of overtravel and the regulation of the speed of movement of the spool is particularly important in earth working equipment where a hydraulic control valve may regulate the movement of a device such as the bucket of a front end loader. Overtravel and unregulated speed of movement of the spool results in erratic bucket action.

In operation, spool 11 maintained in its neutral position by the force provided by spring 12. When spool 11 is moved axially in either direction within housing 40 through a force provided by operating lever 13, the spool will be maintained in first or second operating positions either through the attraction of electromagnet 15 for disc 14, or through the engagement of detent balls 17 in detent grooves 16. When lever 13 is used to provide a force to disengage the spool from either of the two detent devices, spring 12 provides a force to return the spool to neutral.

As spool 11 returns towards its neutral position, balls 24 move freely on reduced diameter portions 35 and 36 until the balls engage either of inclined ramp surfaces 37 or 38. Balls 24 are vertically moved when the spool has moved a predetermined distance as it travels towards one of its operating positions. When balls 24 are moved into engagement with either inclined surface 37 or 38, the balls are moved radially outward with respect to the spool and engage conical surfaces 25 provided on cam bushing 11. Conical surfaces 25 provide an axial force to move the balls against the confronting surface of piston 27 resulting in axial displacement of the piston.

Fluid, previously admitted into chamber 30 via inlet 43 and check valve 31, is discharged therefrom through orifice 32 as a result of the axial displacement of the piston. Since orifice 32 restricts the flow of fluid from chamber 30, there is a resultant increase in the pressure of the fluid remaining in chamber 30; the pressurized fluid provides a reaction force acting on piston 27 to move the piston axially towards balls 24 which, in turn, increases the reaction force developed by the balls against ramp like surfaces 37 or 38. The reaction force thus developed between the balls and ramp surfaces restrains the free movement of spool 11 as it travels from an operating position towards the neutral position. The magnitude of the restraining force on spool 11 is a function of the size of orifice 32, the angle of ramp surfaces 37 and 38 and the degree of radial movement of balls 24. It may be readily noted, the restraining force on spool 11 may be independently varied for each direction of spool movement by changing the angle of either ramp surface 37 or 38 or varying the diameter of either reduced diameter portion 35 or 36 to change the radial lift of balls 24.

The dampening system of the present invention is compact, provides an independent dampening force for each direction of spool movement and may be readily integrated into a hydraulic control valve to prevent spool overtravel and control the approach speed of the spool towards the neutral position.

While a preferred embodiment of the present invention has been described and illustrated, the invention should not be limited thereto but may be otherwise embodied within the scope of the following claims.

The embodiments of the invention in which an exclusive property or privilege is claimed are defined as follows:

1. A hydraulic control valve comprising:

a valve housing;

an axially movable spool valve normally disposed in a neutral position within said housing;

first force producing means connected to and intermittently actuating said spool valve for moving said valve in an axial direction within the housing from said neutral position;

means for latching said spool valve at a predetermined axial position spaced from said neutral position;

second force producing means connected to said spool valve for delatching and returning said valve to its neutral position when said first means is deactuated; and a dampening system for controlling the return movement of the valve to the neutral position from its latched axial position including:

means defining a chamber;

piston means movably disposed within the chamber;

fluid supply means for delivering fluid into said chamber;

fluid flow control means for controlling the flow of fluid from said chamber; and means responsive to movement of said spool valve from its latched position towards said neutral position for axially displacing said piston means within said chamber to reduce the effective volume thereof and develop a hydraulic force as the fluid is forced from said chamber under control of said fluid flow control means, said hydraulic force acting in opposition to the spool valve return force generated by said second force producing means to dampen movement of said spool valve towards said neutral position, said means for axially displacing said piston including a first pair of inclined surfaces connected to and movable with said spool valve;

a valve member provided in said valve housing in contact with said inclined surfaces;

and a ramp surface radially spaced from said inclined surfaces, said valve member being disposed between said inclined and ramp surfaces, whereby relative motion of said inclined surfaces with respect to said valve member urges said valve member against a confronting surface of said piston for axially displacing said piston.

2. A hydraulic control valve in accordance with claim 1 wherein said fluid flow control means is an orifice.

3. A hydraulic control valve comprising:

a valve housing;

an axially movable spool valve normally disposed in a neutral position within said housing;

first force producing means connected to and intermittently actuating said spool valve for moving said valve in an axial direction within the housing from said neutral position;

means for latching said spool valve at a predetermined axial position spaced from said neutral position;

second force producing means connected to said spool valve for delatching and returning said valve to its neutral position when said first means is deactuated; and a dampening system for controlling the return movement of the valve to the neutral position from its latched axial position including:

means defining a chamber;

piston means movably disposed within the chamber;

fluid supply means for delivering fluid into said chamber;

fluid flow control means for controlling the flow of fluid from said chamber; and means responsive to movement of said spool valve from its latched position towards said neuttral position for axially displacing said piston means within said chamber to reduce the effective volume thereof and develop a hydraulic force as the fluid is forced from said chamber under control of said fluid flow control means, said hydraulic force acting in opposition to the spool valve return force generated by said second force producing means to dampen movement of said spool valve towards said neutral position, said means for axially displacing said piston including:

cam means connected to and movable with said spool valve; and cam follower means actuated by axial movement of said spool valve and guided by same cam means against a confronting surface of said piston for axially displacing said piston.

4. A hydraulic control valve in accordance with claim 3 wherein said fluid flow control means is an orifice.

5. A fluid dampening system for a hydraulic control valve including a spool valve intermittently movable between a neutral position and a preselected axially spaced position, and means for latching said spool valve in said preselected position, said fluid dampening system including:

means defining a fluid receiving chamber;

piston means movably disposed within the chamber;

fluid supply means for delivering fluid into said chamber;

fluid flow control means for controlling the flow of fluid from said chamber; and means for returning said spool valve to its neutral position from said preselected position including force generating means responsive to the movement of said spool valve towards its neutral position operable to displace said piston means to discharge fluid from said chamber through said fluid flow control means to develop a fluid reactive force acting on said spool valve to dampen movement thereof towards said neutral position, wherein said force generating means includes cam means connected to and movable with said spool valve; and cam follower means actuated by motion of said spool valve and guided by said cam means against a confronting surface of said piston means for axially displacing said piston.

6. A fluid dampening system in accordance with claim 5, wherein said flow control means is an orifice.

* * * * *